US008789290B2

(12) United States Patent
Grunert

(10) Patent No.: US 8,789,290 B2
(45) Date of Patent: Jul. 29, 2014

(54) DOMESTIC APPLIANCE FOR THE CARE OF ITEMS OF WASHING AND METHOD FOR REMOVING LINT

(75) Inventor: Klaus Grunert, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 96 days.

(21) Appl. No.: 12/313,865

(22) Filed: Nov. 24, 2008

(65) Prior Publication Data

US 2009/0151191 A1 Jun. 18, 2009

(30) Foreign Application Priority Data

Dec. 18, 2007 (DE) ..... 10 2007 060 851

(51) Int. Cl.
*D06F 58/22* (2006.01)
*F26B 3/02* (2006.01)
*F26B 25/04* (2006.01)

(52) U.S. Cl.
CPC ..... *D06F 58/22* (2013.01)
USPC ..... 34/469; 34/480; 34/73; 34/82

(58) Field of Classification Search
CPC ..... F26B 11/00; F26B 25/04; F26B 25/007; D06F 58/22; B01D 29/64; B01D 29/6469
USPC ..... 34/467, 468, 469, 73, 82, 130, 595
See application file for complete search history.

(56) References Cited

U.S. PATENT DOCUMENTS

| | | | | |
|---|---|---|---|---|
| 3,027,653 | A * | 4/1962 | Long et al. | 34/86 |
| 3,571,841 | A * | 3/1971 | Crouser | 15/401 |
| 2006/0123854 | A1 | 6/2006 | Hong et al. | |
| 2007/0022790 | A1 | 2/2007 | Slutsky et al. | |
| 2007/0107251 | A1 | 5/2007 | Goldberg et al. | |
| 2007/0108181 | A1 | 5/2007 | Gassmann et al. | |
| 2008/0307667 | A1 * | 12/2008 | Ikemizu | 34/132 |

FOREIGN PATENT DOCUMENTS

| | | | |
|---|---|---|---|
| DE | 3738031 | A1 | 5/1989 |
| DE | 19919407 | A1 * | 11/2000 |
| EP | 0 648 885 | | 4/1995 |
| EP | 0816549 | A2 | 1/1998 |
| JP | 07236796 | A * | 9/1995 |

OTHER PUBLICATIONS

Machine translation of Grunert (DE19919407 A1).*
Machine translation of Yoshimi et al. (JP 07-236796).*
Machine translation of Chabanne et al. (EP0 648885 A1).*

* cited by examiner

*Primary Examiner* — Jiping Lu
(74) *Attorney, Agent, or Firm* — James E. Howard; Andrew Pallapies

(57) ABSTRACT

A domestic appliance for the care of items of washing includes a process air supply through which a stream of air is able to be directed through a drum for holding the items of washing, a mesh filter for separating the lint out of the air stream, a facility for removing lint from the mesh filter, the facility being embodied for removal of lint which is collected outside the process air supply on the mesh filter, and a rinsing device with which the lint is able to be rinsed out of the mesh filter with rinsing fluid. A method for removal of lint from a mesh filter of the domestic appliance also is provided.

14 Claims, 1 Drawing Sheet

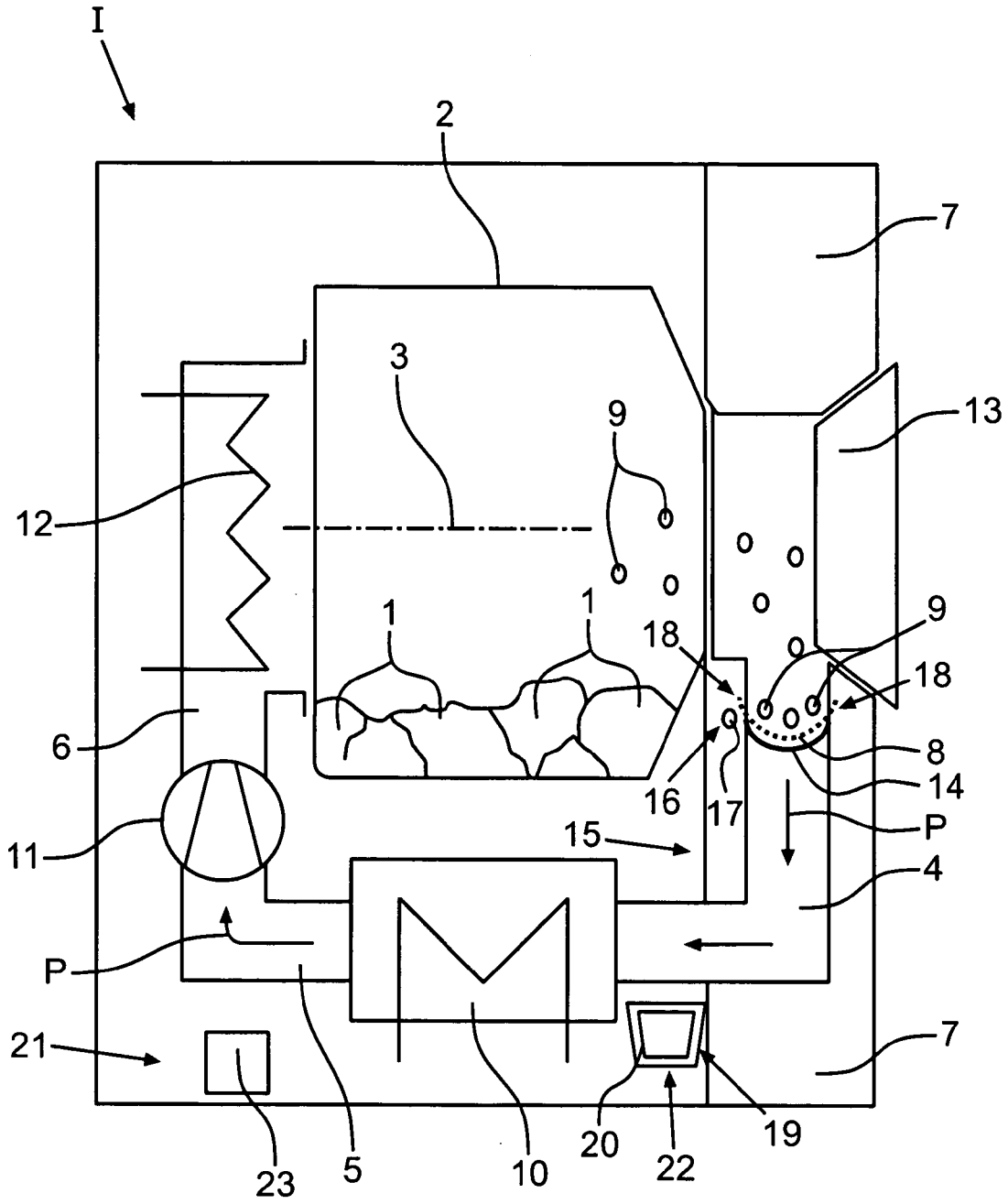
I
2
7
3
9
13
12
1
1
18
9
18
6
8
14
16
17
P
11
15
4
P
21
7
23
5
10
20
22
19

DOMESTIC APPLIANCE FOR THE CARE OF ITEMS OF WASHING AND METHOD FOR REMOVING LINT

BACKGROUND OF THE INVENTION

The invention relates to a domestic appliance for the care of items of washing, with a process air supply through which an air stream is able to be directed through a drum for holding the items of washing and which includes a mesh filter for separating lint out of the air stream, and with a facility for removing lint from the mesh filter. The invention further relates to a method for removing lint which is collected on a mesh filter arranged in certain areas in a process air supply of a domestic appliance for care of items of washing and is removed by a facility for removing lint from the mesh filter.

BRIEF SUMMARY OF THE INVENTION

A facility for drying washing using a stream of air is known from publications EP 1 788 140 A1, EP 1 788 141 A2 and EP 1 788 141 A2. In the dryer a mesh filter for filtering lint out of a stream of air of the process air supply is arranged in the area of the end shield. A squeegee is used to wipe the lint accumulated on the mesh filter in the process air supply away from the mesh of the filter and store it in a container arranged adjacent to the squeegee and to the mesh filter. However the installation space available in the area of the squeegee means that this container has relatively small dimensions. It allows lint from between 7 and 10 drying processes to be collected. Since the lint is stored in the dry state, it occupies a relatively large volume. On the one hand access to the collection vessel in these dryers is restricted and on the other hand the collection volume is limited by its arrangement in a zone of the dryer where space is limited, which results in a relatively frequent maintenance interval for removal of lint from the container.

An object of the present invention is to create a domestic appliance for the care of items of washing as well as a method for removal of lint from a mesh filter of the domestic appliance which on the one hand makes possible enhanced removal of the lint and on the other hand increases the interval for disposal of the collected lint.

An inventive domestic appliance for the care of items of washing comprises a process air supply through which a stream of air is able to be directed through a drum of the domestic appliance into which the items of washing to be dried are introduced. The domestic appliance additionally features a mesh filter assigned to the process air supply for separating or filtering out lint from the stream of air, and also features a facility for removing the lint from the mesh filter. This device for removal of lint is specifically embodied so that the lint collected on the mesh filter outside the process air supply or outside the stream of air is able to be removed. The facility for removal of lint comprises a rinsing device with which this lint arranged outside the process air supply or outside the air stream can be rinsed off the mesh filter by means of rinsing fluid. This embodiment enables the removal of lint from the mesh filter to be improved.

Preferably the domestic appliance includes a squeegee by means of which the lint collected on the mesh filter in the process air supply is able to be removed. Preferably by actuating the squeegee the lint is collected outside the process air supply at the edge of the mesh filter. The squeegee is thus designed such that it is intended for removal of the lint from the mesh filter, with only a part of the lint being able to be removed by actuation of the squeegee. A further part of the lint is moved to the edge of the mesh filter outside the process air supply especially by the squeegee and remains attached to the mesh filter there. It is precisely this lint adhering to the edge of the mesh filter that can be removed by the facility for removal of lint by rinsing with the rinsing fluid. The domestic appliance thus preferably includes the device for removing the lint and the squeegee embodied separately from the device. This enables the lint arranged at specific locations on the mesh filter or conveyed there to be effectively removed.

The squeegee can for example be embodied in accordance with the embodiment in EP 1 788 141 A2 as a thrust strip. However other embodiments of a squeegee are also possible.

It has proved especially preferable for the rinsing fluid of the rinsing device to be a condensate accrued during the operation of the domestic appliance. A waste product of the domestic appliance can thus be usefully employed.

Preferably the lint removed by the rinsing fluid can be directed into a floor pan of the domestic appliance. In particular a collection vessel is arranged in the floor pan which is embodied to hold the lint-laden rinsing fluid and for filtering the lint out of the rinsing fluid. This is an especially advantageous embodiment, since there is usually more space available in the floor pan for the collection vessel. This allows the vessel to be dimensioned larger, whereby longer maintenance intervals are produced in respect of the removal of lint. Especially advantageously the lint is thus not stored or not only stored in the area of the squeegee, but is transported by being rinsed away with condensation water into the area of the floor pan.

In principle the removal of the lint accumulated at specific locations with rinsing fluid also has the advantage of the lint taking up much less volume when moistened than that occupied by lint removed and collected dry.

The arrangement of a collection vessel in the floor pan and the collection of the lint removed with the rinsing fluid from the mesh filter in this collection vessel also enable an improved access for a user of the domestic appliance for disposal of the lint.

It proves especially preferable for the collection vessel to have an outlet through which the lint-filtered rinsing fluid can be directed out of the collection vessel. The removal of the lint from the rinsing can thus be generated automatically and the draining of the rinsing fluid from the collection vessel generated automatically. In particular the lint-filtered rinsing fluid is able to be drained out of the collection vessel into the floor pan. In this regard a relatively large volume for accommodating condensation water and rinsing fluid is available which can then preferably be pumped away via a pump. In this context there can be provision for the fluid to be pumped out into a trap or siphon and thus drained into a waste water disposal network external to the domestic appliance. There can however also be provision for the condensate and the rinsing fluid to be pumped into a container provided separately for the purpose, which can then be removed by a user of the domestic appliance in order to enable the liquid collected in it to be disposed of in a wash basin or such like.

Preferably the collection vessel arranged in the floor pan can be detached without destroying it and is thus arranged to allow its removal and replacement in the floor pan. This allows simple removal for disposal of the lint from the collection vessel.

It proves especially advantageous for the collection vessel to feature a filter device for filtering the lint out of the rinsing fluid which can be released from the vessel or is arranged in or on the collection vessel and which lets the rinsing fluid pass through it. In such an embodiment it is then no longer necessary for the entire collection vessel to have to be removed from the domestic appliance but it is sufficient to remove the filter device. In this context there is especially advantageously provision for the filter device to be disposed of along with the filtered-out lint in a simple and environmentally-friendly manner and for a new filter device to be inserted into the collection vessel in a simple and straightforward manner. In this context a lint bag can be provided which is embodied to be flexible and for example functions using a principle similar to a coffee filter or tea filter. A further advantage of such an embodiment with a removable filter device and the collection vessel is then to be seen in a user of the domestic appliance not then needing to touch the collected lint directly in order to dispose of it from the collection vessel. This thus also has advantages with regard to hygiene.

The lint is thus especially removed manually from the collection vessel arranged in the floor pan.

The advantageous embodiment of the collection vessel and/or its arrangement in the floor pan and the associated larger dimensioning makes possible maintenance intervals for disposing of this lint which allow a far greater number of drying processes without removal of the lint than can be guaranteed in the prior art. Maintenance intervals during regular operation of the domestic appliance can be extended in this connection to between one and six months.

In an inventive method for removal of lint, the lint is collected in a mesh filter arranged in certain areas in a process air supply of a domestic appliance for care of items of washing. The lint is removed by a facility for removing lint from the mesh filter. With this facility the lint collected outside the process air supply on the mesh filter is removed by a rinsing device assigned to the facility, in that a rinsing fluid can be directed to the specific area of the mesh filter and the lint can be rinsed off the mesh filter.

Preferably the lint which is removed by the facility can be collected at the side edge of the mesh filter outside the process air supply by actuating a squeegee (e.g., a scraper) which is provided as unit for removal of the lint in addition to the facility in the domestic appliance. Thus the lint collected in the mesh filter in the process air supply is basically removed from the mesh filter by the squeegee (e.g., scraper), with lint additionally being deposited in this process at the edge to the side of the mesh filter. To remove this deposited lint the facility is provided which, separately from the squeegee (e.g., scraper), uses rinsing of this edge area at the side of the mesh filter to remove the lint deposited there.

Preferably the rinsing fluid laden with the lint rinsed off the mesh filter is directed into a floor pan of the domestic appliance. In particular the rinsing fluid laden with lint is directed into a collection vessel arranged in the floor pan by the lint being filtered out of the rinsing fluid. It is precisely by arranging the collection vessel in this location that enables the vessel to have larger dimensions as a result of the larger installation space available in the floor pan, so that this can also accommodate a greater volume of lint. This allows the maintenance intervals for disposing of the lint from the collection vessel to be greatly extended. The fact that the lint is moistened by the rinsing fluid means that it also has a significantly lower volume than it would have if it were disposed of and collected in a dry state. This also allows the amount of lint to be collected in the collection vessel to be increased.

Preferably the lint-filtered rinsing fluid is drained out through an outlet in the collection vessel, especially into the floor pan. The rinsing fluid is thus filtered out automatically, with a preferred automatic draining of the rinsing fluid from which the lint has been cleaned additionally able to be undertaken. In particular the lint is filtered out from the rinsing fluid in a filter device of the collection vessel which is removable from the collection vessel and through which the rinsing fluid can pass.

Advantageous embodiments of the inventive domestic appliance are to be seen as advantageous embodiments of the inventive method.

BRIEF DESCRIPTION OF THE DRAWING

An exemplary embodiment of the invention is explained in greater detail with reference to the following drawing:

FIG. 1 shows a schematic cross-sectional view of an exemplary domestic appliance.

DETAILED DESCRIPTION OF AN EXEMPLARY EMBODIMENT OF THE PRESENT INVENTION

A domestic appliance for the care of items of washing as depicted in the figure is embodied as a condensing dryer I.

The condensing dryer I comprises a drum 2 which is embodied for holding items 1 of washing to be dried. The drum 2 is supported rotatably around a horizontal axis 3.

In addition the condensing dryer I comprises a process air supply which is embodied as a closed process air circuit. The process air supply comprises a falling section 4, which passes into a horizontal section 5 which in its turn runs back into a rising section 6. The air stream P guided in the process air supply is guided in the duct system 4, 5, 6 of the process air supply, with the falling section 4 partly running in an end shield 7 of the condensing dryer 1.

In the exemplary embodiment a mesh filter 8 is positioned in the falling section 4 of the process air supply which is arranged in the end shield 7. Lint 9 contained in the stream of air P is filtered out by the mesh filter 8.

The lint 9 is detached from the items of washing 1 as the stream of air P flows through the drum 2 and is filtered out by flowing in the direction shown by the arrow in the process air supply through the mesh filter 8. The lint 9 in such cases remains essentially hanging in the mesh filter 8 in the process air supply.

A heat exchanger 10 is provided in the horizontal section 5 following the section 4 in which the air stream P is cooled off for condensing out the water vapor carried along in it. Condensed water is separated from the air stream P and disposed of by the means known per se and not shown in FIG. 1. The water can also be condensed out from the cooling air stream P in other ways. In this connection the embodiment with the one heat exchanger 10 merely serves as an example. The condensing dryer I can also include a heat pump circuit which features an evaporator and a condenser which are linked via a working medium circuit in which coolant is routed. A compressor and a choke are then also preferably arranged in the coolant medium circuit, so that one the one hand coolant can be compressed and evaporated and on the other hand can be expanded and condensed Such a heat pump circuit on the one hand enables the moisture to be removed from the air stream coming out of the drum 2 by cooling it down and on the other hand allows the air stream P flowing back into the drum 2 to be heated up.

In the exemplary embodiment a fan 11 is further arranged in the process air supply which creates the circulation of the stream of air P. Also arranged in the rising section 6 of the process air supply in the exemplary embodiment is a heating device 12, through which the air stream P is heated up again before its entry into the drum 2.

The end shield 7 on the one hand forms a support structure for a front side of the condensing dryer I as well as a front-side support for the drum 2, and on the other hand supports a door 13 for closing of the drum 2 or for closing off a loading opening of the drum 2.

The condensing dryer I in addition features a symbolically shown squeegee 14 (e.g., a scraper), which is embodied for removal of the lint 9 from the mesh filter 8 in the area of the process air supply.

When the squeegee 14 (e.g., scraper) is actuated the lint adhering to the mesh filter 8 in the process air supply is wiped off the mesh filter 8 and removed. However this actuation also causes lint 9 to build up at an edge 18 of the mesh filter 8 or to be transported there by the squeegee 14 (e.g., scraper).

To enable this lint 9 adhering to the mesh 8 at the edge 18 outside the process air supply or outside the air stream P to be removed, the condensing dryer I features a facility 15. The facility is thus embodied separately and in addition to the squeegee 14 (e.g., scraper).

The facility 15 comprises a rinsing device 16 featuring at least one spray nozzle 17. Rinsing fluid is sprayed via the nozzle 17 onto the edge 18 and this rinsing causes the lint 9 adhering to the edge to be rinsed off. The rinsing fluid is the condensate occurring during the operation of the condensing dryer I which is collected in a floor pan 21.

To convey the condensate collected in the floor pan 21 to the rinsing device 16, and especially to the nozzle 17, a pump 23 is provided. Depending on the desired operating state the condensate collected in the floor pan 21 is then either conveyed to the nozzle 17 or, if the mesh filter 8 does not need to be rinsed with rinsing fluid or with condensate or there is no provision for this to be done, it is for example conveyed out of the condensing dryer I outwards into a trap. For this purpose the condensing dryer I includes a valve which is connected via a line system to the pump 23. The two outflows of the Y-valve thus lead on one hand to the spray head 17 and on the other hand out of the condensing dryer I, with in this regard a system of lines leading to outside the dryer being provided, which comes out into the traps. The valve and the pump 23 are controlled by an electronic control unit not shown in the figure.

The device 15 further comprises a line system not shown in the figure which, after the mesh filter 8, especially the edge 18, has been rinsed with the rinsing fluid, then routes the rinsing fluid laden with the lint 9 into a collection vessel 19. The collection vessel 19 is arranged in the floor pan 21. Because of the greater space in the area of the floor pan 21 the collection vessel 19 can be dimensioned larger than if it were arranged in the area of the end shield 7 adjacent to the mesh filter 8. There can however also be provision, in addition to the collection vessel 19 and its arrangement in a floor pan 21, for a further collection vessel to be arranged in the area of the mesh filter 8 which is provided for receiving the lint 9 which is conveyed by the squeegee 14 into this further collection vessel.

The collection vessel 19 arranged in the floor pan 21 includes in the exemplary embodiment a filter device 20 which can be taken out of the collection vessel 19. This filter device 20 is embodied as flexible and deformable and designed as a sack or bag. The filter device 20 is embodied so that the rinsing fluid can pass through it but it filters out the lint 9 contained in the rinsing fluid.

The collection vessel 19 also comprises an outlet 22, through which the lint-filtered rinsing fluid can again flow into the floor pan 21.

The collection vessel 19 and especially the filter device 20 are arranged in the floor pan 21 so that for example they are easily accessible from outside via a flap on the dryer I and thus can be removed in a simple and straightforward manner by the user.

It should also be mentioned that the embodiment of the process air supply with the heat exchanger 10, the fan 11 and the heating device 12 merely serves as an example. The important aspect of the invention is that the condensing dryer I features the facility 15 with which the lint 9, which especially adheres to the edges of the mesh filter 8 and especially collects outside the process air supply on the mesh filter 8, can be removed by being rinsed off with a rinsing fluid, especially the collected condensate, and this can take place especially in a collection vessel 19 arranged in the floor pan 21.

By disposing of this lint 9 adhering to specific locations into a collection vessel 19 arranged in the floor pan 21, because of the pan's greater dimensions the frequency of the disposal of the lint can be significantly reduced. Maintenance intervals can be achieved in this way which allow the emptying of the collection vessel 19 to only be required in the time frame of between one and six months.

The invention claimed is:

1. A domestic appliance for care of items of washing, comprising:

a drum for accepting the items of washing;

a process air supply having walls defining a duct through which a stream of air is directed through the drum;

a mesh filter for separation of lint from the air stream, the mesh filter including:

a portion disposed between the walls of the duct of the process air supply and in the stream of air; and a side edge disposed outside of the process air supply and outside the stream of air;

a scraper movable with respect to the mesh filter to remove the lint from the portion of the mesh filter and to collect the lint on a surface of the side edge of the mesh filter that is outside the process air supply and outside the stream of air; and a rinsing device configured to direct rinsing fluid onto the collected lint on the surface of the side edge of the mesh filter to wet the collected lint to reduce an amount of space needed to store the collected lint and to remove the collected lint from the side edge of the mesh filter.

2. The domestic appliance of claim 1, wherein the rinsing fluid comprises a condensate in the domestic appliance during its operation.

3. The domestic appliance of claim 1, wherein the lint removed from the side edge of the mesh filter by the rinsing fluid can be directed into a floor pan of the domestic appliance.

4. The domestic appliance of claim 3, further comprising a collection vessel in a floor pan for the rinsing fluid laden with lint and for filtering the lint out of the rinsing fluid.

5. The domestic appliance of claim 4, wherein the collection vessel comprises an outlet through which the rinsing fluid from which the lint has been filtered out can be drained out of the collection vessel.

6. The domestic appliance of claim 5, wherein the rinsing fluid from which the lint has been filtered out is able to be drained out into the floor pan.

7. The domestic appliance of claim 4, wherein the collection vessel is removable from the floor pan.

8. The domestic appliance of claim 4, wherein the collection vessel comprises a filter device for filtering the lint out of the rinsing fluid, for allowing removal of the filtered lint from the collection vessel, and through which rinsing fluid can pass.

9. The domestic appliance of claim 1, wherein the domestic appliance comprises a condensing dryer.

10. A method for removing lint from a mesh filter in a process air supply of a domestic appliance for care of items of washing, the method comprising:

collecting the lint from an air stream in the process air supply using a portion of the mesh filter that is disposed between walls of a duct defining the process air stream, the portion between the walls of the duct being in the air stream;

moving, using a scraper, the lint that is collected on the portion of the mesh filter to a surface of a side edge of the mesh filter that is not between the walls of the duct and that is outside the process air supply and outside the stream of air such that the lint remains collected on the surface of the side edge of the mesh filter; and removing the lint collected at the side edge of the mesh filter, which is not between the walls of the duct and is outside the process air supply and outside the stream of air, by directing a rinsing fluid to the side edge of the mesh filter and wetting the lint that is collected on the surface of the side edge with the rinsing fluid to reduce an amount of space needed to store the lint and rinsing the lint from the side edge of the mesh filter with the rinsing fluid to wash the lint from the side edge of the mesh filter.

11. The method of claim 10, further comprising directing the rinsing fluid laden with lint that has been rinsed from the side edge of the mesh filter into a floor pan.

12. The method of claim 11, further comprising filtering the lint from the rinsing fluid in a collection vessel in the floor pan.

13. The method of claim 12, further comprising draining the filtered rinsing fluid through an outlet in the collection vessel.

14. The method of claim 12, wherein the collection vessel comprises a removable filter through which the rinsing fluid can pass.

* * * * *